US007431178B2

(12) United States Patent
Allen

(10) Patent No.: US 7,431,178 B2
(45) Date of Patent: Oct. 7, 2008

(54) TOOTHPASTE DISPENSER

(76) Inventor: Duane Parker Allen, 1506 Southwick Dr., Tecumseh, MI (US) 48286

( * ) Notice: Subject to any disclaimer, the term of this patent is extended or adjusted under 35 U.S.C. 154(b) by 410 days.

(21) Appl. No.: 11/162,993

(22) Filed: Sep. 30, 2005

(65) Prior Publication Data

US 2007/0075092 A1 Apr. 5, 2007

(51) Int. Cl.
*B65D 35/28* (2006.01)

(52) U.S. Cl. ..... 222/102; 222/101; 222/103

(58) Field of Classification Search ..... 222/107, 222/92, 93, 95, 96, 98, 102, 100, 101, 103, 222/105, 390, 94, 104
See application file for complete search history.

(56) References Cited

U.S. PATENT DOCUMENTS

| | | | | | |
|---|---|---|---|---|---|
| 1,311,354 | A | | 7/1919 | King | |
| 1,841,275 | A | * | 1/1932 | Baptiste | 222/96 |
| 2,085,673 | A | | 6/1937 | Roache | |
| 2,109,564 | A | * | 3/1938 | Bennett | 222/93 |
| 2,140,007 | A | | 12/1938 | Grandman | |
| 2,551,909 | A | * | 5/1951 | Soileau | 222/97 |
| 2,605,932 | A | * | 8/1952 | Locke | 222/80 |
| 2,712,400 | A | | 7/1955 | Stauffer | |
| 2,772,028 | A | | 11/1956 | Lopez | |
| 2,901,147 | A | * | 8/1959 | Bond, Jr. | 222/102 |
| 3,187,951 | A | * | 6/1965 | Hardman et al. | 222/102 |
| 3,860,147 | A | | 1/1975 | Vessio et al. | 222/96 |
| 3,915,342 | A | | 10/1975 | Van Bussel | 222/103 |
| 4,125,206 | A | | 11/1978 | Wilson | 222/101 |
| 4,234,104 | A | | 11/1980 | Apuzzo, Jr. et al. | 222/94 |
| 4,258,864 | A | | 3/1981 | Karamanolis et al. | 222/96 |
| 4,403,714 | A | | 9/1983 | Kane | 222/101 |
| 4,508,242 | A | | 4/1985 | Wolfe | 222/102 |
| 4,585,147 | A | | 4/1986 | Wodnicki | 222/50 |
| 5,050,773 | A | | 9/1991 | Choi | 222/63 |
| 5,195,659 | A | * | 3/1993 | Eiskant | 222/102 |
| 5,573,138 | A | * | 11/1996 | Lin | 222/96 |
| 5,957,334 | A | * | 9/1999 | Rosario | 222/102 |
| 6,318,596 | B1 | | 11/2001 | Wiesner | 222/1 |
| 6,378,732 | B1 | * | 4/2002 | Park | 222/102 |
| 6,401,978 | B1 | | 6/2002 | Young | 222/101 |
| 6,880,726 | B1 | * | 4/2005 | Perez | 222/102 |
| 2002/0170923 | A1 | | 11/2002 | Vatman | 222/102 |

FOREIGN PATENT DOCUMENTS

| | | | | |
|---|---|---|---|---|
| DE | 0497124 A1 | * | 1/1992 | 222/102 |

* cited by examiner

*Primary Examiner*—Kevin P. Shaver
*Assistant Examiner*—Stephanie E Tyler
(74) *Attorney, Agent, or Firm*—Hartman & Hartman, P.C.; Gary M. Hartman; Domenica N. S. Hartman

(57) ABSTRACT

An apparatus for dispensing the contents of a collapsible tube, such as a toothpaste tube. The apparatus includes a housing having side walls, an end wall with an opening therein, and a cover pivotally attached to the housing to provided access to a cavity within the housing. A squeezing device is slidably received in the cavity and includes a threaded surface the cover and a pair of opposing surface that define a though-slot that increases in width toward the housing end wall. A threaded rod is rotatably mounted to the cover and engages the threaded surface of the squeezing device when the cover is closed and disengages the threaded surface when the cover is opened. By rotating the rod, the squeezing device can be caused to move along the rod toward and away from the end wall of the housing.

20 Claims, 2 Drawing Sheets

FIG.4
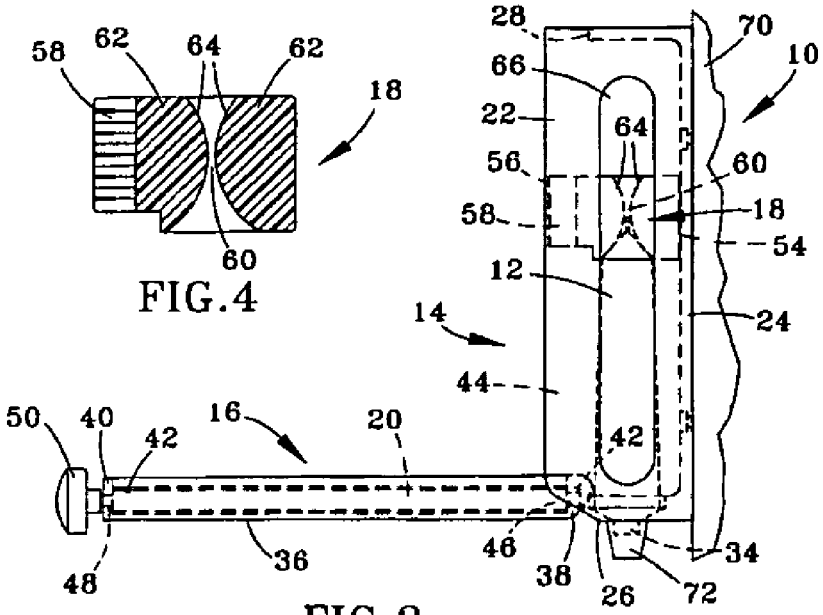
FIG.3
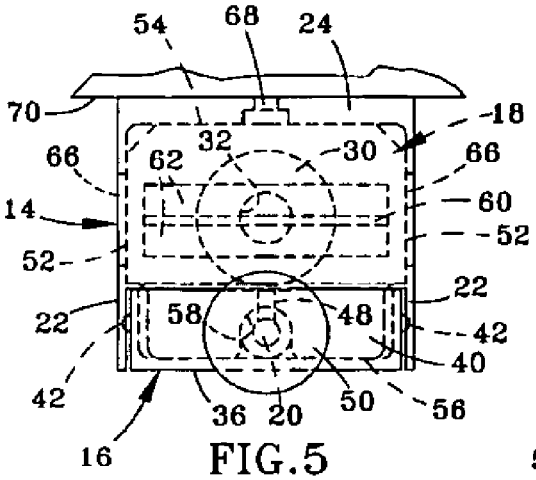
FIG.5
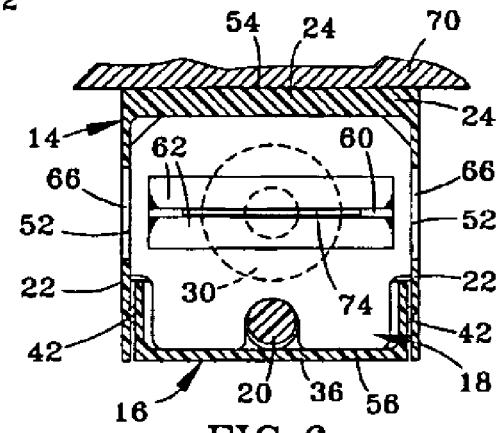
FIG.6

TOOTHPASTE DISPENSER

BACKGROUND OF THE INVENTION

The present invention generally relates to dispensers for pastes stored in collapsible tubes. More particularly, this invention relates to a toothpaste dispenser that is relatively inexpensive, easy to install, and simple to operate and replace spent tubes.

Various devices have been proposed for dispensing toothpaste and other substances from a collapsible tube. Generally, these dispensers have been operated manually or through an electric motor. For example, U.S. Pat. No. 6,401,978 to Young describes a device that dispenses toothpaste from a tube through the operation of a threaded rod driven by a motor. A toothpaste tube within the device is caused to dispense toothpaste by rotating the rod with the motor, which causes a unitary squeezer (slider) to travel the length of the rod, forcing the back end of the tube through a tapered passage within the squeezer. Another example is U.S. Pat. No. 4,585,147 to Wodnicki, which discloses the use of an opposing pair of flexible squeezers, each mounted to a threaded shaft. The shafts operate in unison through a gear set and a manually-operated knob at the top of the dispenser housing.

The toothpaste dispenser of Young is complicated by the use of a motor that requires an electrical power connection, while Wodnicki's dispenser has the disadvantage of requiring that the squeezer is returned to its starting position by manually operating the knob before a new tube can be inserted.

Accordingly, there is an ongoing need for a toothpaste dispenser that is easy to install, use, and operate.

BRIEF SUMMARY OF THE INVENTION

The present invention provides an apparatus for dispensing the contents of a collapsible tube, such as a toothpaste tube. The apparatus includes a housing having an internal cavity defined in part by side walls and an end wall with an opening therein, and a cover pivotally attached to the housing adjacent the end wall thereof. The cover is adapted to have a closed position relative to the housing and to provide access to the internal cavity when in an open position. A squeezing device is slidably received in the internal cavity of the housing. The squeezing device has a threaded surface facing the cover and a pair of opposing surfaces that define a slot therebetween. The slot is aligned with the opening in the end wall of the housing and increases in width in a direction toward the end wall. A rod is rotatably mounted to the cover so as to be pivotable therewith relative to the housing. The rod has an external thread that is threadably engaged with the threaded surface of the squeezing device when the cover is in the closed position and is disengaged from the threaded surface of the squeezing device when the cover is in the open position. By rotating the rod, the squeezing device is caused to move along the rod and through the internal cavity selectively toward and away from the end wall of the housing.

Based on the above-described construction, the contents of a collapsible tube can be dispensed from the tube by placing the tube within the internal cavity between the end wall of the housing and the squeezing device so that a nozzle end of the tube is disposed in the opening of the end wall of the housing and a collapsible end of the tube is received in the slot within the squeezing device, and then rotating the rod to cause the squeezing device to move toward the end wall of the housing. In this manner, the collapsible end of the tube is gradually collapsed as it is forced through the slot in the squeezing device.

A significant advantage of the invention is that it is unnecessary to rotate the rod in order to retract the squeezing device in order to replace a spent tube with a second tube. Instead, because the rod is disengaged with the squeezing device when the cover is in the open position, the squeezing device can be simply and freely slid within the internal cavity of the housing while the cover is open to sufficiently space the squeezing device from the end wall of the housing for the purpose of installing the second tube. The ease with which the squeezing device can be operated and its position adjusted within the housing enables the apparatus to be easily used and operated without the need for a motor to operate the rod.

Other objects and advantages of this invention will be better appreciated from the following detailed description.

BRIEF DESCRIPTION OF THE DRAWINGS

FIG. 3 is a side view similar to FIG. 2, but with a cover of the dispenser in an open position to permit access to a tube within the dispenser in accordance with a preferred aspect of the invention.

FIG. 4 is an isolated cross-sectional view of a squeezing block of the dispenser of FIGS. 1 and 2.

FIG. 5 is a top view of the dispenser taken in the direction of line 5-5 in FIG. 1.

FIG. 6 is a sectional of the dispenser taken along line 6-6 of FIG. 1.

DETAILED DESCRIPTION OF THE INVENTION

FIGS. 1 through 6 represent a preferred embodiment of an apparatus 10 for dispensing the contents of a collapsible tube 12 located within an internal cavity 44 of the apparatus 10. While the present invention can be used to dispense a wide variety of substances contained within a collapsible tube, the apparatus 10 will be described as a toothpaste dispenser for dispensing toothpaste from the tube.

Figure 1:
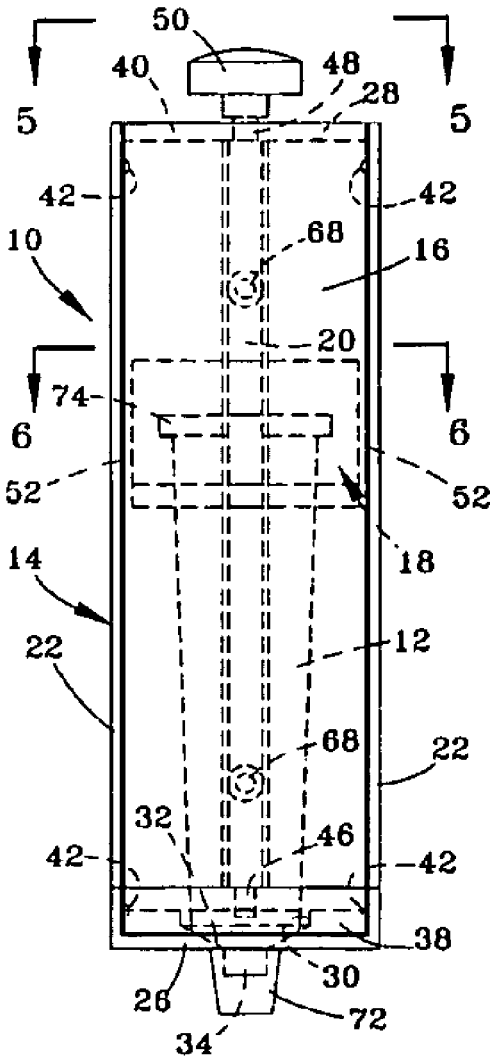
FIGS. 1 and 2 are front and side views, respectively, of a toothpaste dispenser in accordance with a preferred embodiment of this invention.
Figure 2:
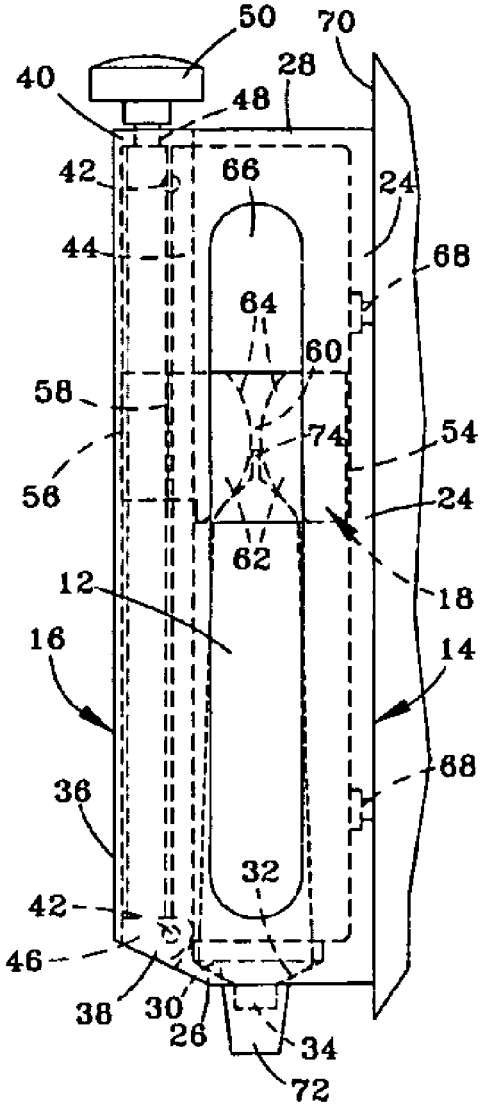

As seen in FIGS. 1 through 3, the dispenser 10 comprises four main components in the form of a housing 14, a cover 16, a tube squeezer 18, and a threaded rod 20. The housing 14 is defined by a pair of parallel side walls 22, a base wall 24 joining and perpendicular to the side walls 22, a bottom and top walls 26 and 28 at opposite ends of the housing 14. The bottom and top walls 26 and 28 each join and are oriented transverse to the side and base walls 22 and 24. Together, the walls 22, 24, 26, and 28 of the housing 14 cooperate to define part of the internal cavity 44 of the dispenser 10 containing the tube 12. The bottom wall 26 defines a recessed pocket 30 and an opening 32 in which one end of the tube 12 is received and through which a nozzle 34 of the tube 12 protrudes, respectively. While various constructions are possible, the housing 14 is shown as having a unitary construction that enables the housing 14 to be produced by, for example, injection molding. Windows 66 are preferably provided in the side walls 22 to permit a user to check the fill level of the tube 12 and the position of the tube squeezer 18 within the cavity 44. A pair of flat-bottom through-holes 68 are shown as being provided on the base wall 24 of the housing 14 by which the dispenser 10 can be mounted to a wall 70. However, it is foreseeable and within the scope of this invention that alternative methods could be used to attach the dispenser 10 to a wall.

As can be seen from FIGS. 2 and 3, the cover 16 is pivotably attached at its lower end to the housing 14. More particularly, as seen in FIGS. 2 and 3 the cover 16 is configured to comprise a front panel 36, a lower flange 38 adjacent the bottom wall 26 of the housing 14, and an upper flange 40 adjacent the top wall 28 of the housing 14. According to a preferred aspect of the invention, the housing 14 and cover 16 are equipped with complementary detent features 42 located adjacent the lower and upper flanges 38 and 40 of the cover 16. The detent features 42 at the lower end of the cover 16 define an axis about which the cover 16 pivots relative to the housing 14 between a closed position in which the cover 16 closes the housing cavity 44 and an open position in which the cover 16 is rotated away from the housing 14 to permit access to the cavity 44. The detent features 42 at the upper end of the cover 16 enable the cover 16 to be secured to the housing 14 in the closed position, but readily releasable from the housing 14 in order to open the cover 16.

As seen in FIGS. 1 through 3, the lower and upper flanges 38 and 40 of the cover 16 rotatably support the threaded rod 20. More particularly, the lower end of the rod 20 is received in a bore 46 defined in the lower flange 38, while the upper end of the rod 20 is attached to the upper flange 40 by a snap-in feature 48 and extends out through the upper flange 40. As such, the rod 20 pivots with the cover 16 relative to the housing 14. A knob 50 is attached to the upper end of the rod 20 by which the rod 20 can be rotated from outside the dispenser 10 and, in the manner described below, by which the tube squeezer 18 can be caused to move parallel to the rod 20.

The tube squeezer 18 is shown as being enclosed within the housing cavity 44. The squeezer 18 generally has a block-like shape that defines side walls 52 in sliding contact with the side walls 22 of the housing 14, a rear wall 54 in sliding contact with the base wall 24 of the housing 14, and a front wall 56 in sliding contact with the front panel 36 of the cover 16. A partial internal thread 58 is defined in the surface of the front wall 56. A slot 60 that extends entirely through the squeezer 18 is defined by a pair of partial cylindrical sections 62 whose opposing arcuate surfaces 64 form the slot 60, such that the slot 60 increases in width in directions both toward and away from the bottom wall 26 of the housing 14. However, it is foreseeable that the slot 60 could have a variety of profile shapes, including a simple taper that increases the width of the slot 60 in the direction toward the bottom wall 26 of the housing 14. The only requirement for the slot 60 is the ability to accommodate the collapsible end 74 of the tube 12 and force the contents of the tube 12 toward the nozzle 34 of the tube 12 when the squeezer 18 is forced downward through the cavity 44 toward the bottom wall 26 of the housing 14. However, as a result of being formed by the arcuate surfaces 64 as shown, the slot 60 is capable of more completely removing the paste from the tube 12 as compared to a simple tapered slot. The squeezer 18 may be formed as a unitary structure as shown, such as by injection molding plastic, or its individual components can be separately formed and then assembled.

The partial internal thread 58 is located on the squeezer 18 and formed to have an appropriate pitch to engage the threads of the rod 20 when the cover 16 is closed. In this manner, with the cover 16 closed the squeezer 18 can be caused to move toward and away from the bottom wall 26 of the housing 14 by rotating the rod 20 with the knob 50. Importantly, this arrangement also enables the rod 20 to be completely disengaged from the partial internal thread 58 of the squeezer 18 by opening the cover 16 as shown in FIG. 3, permitting the squeezer 18 to be freely moved within the cavity 44 toward and away from the bottom wall 26 of the housing 14. By opening the cover 16 it is also possible that the squeezer 18 can be entirely removed from the housing 14 without the use of any tools. As such, the dispenser 10 avoids the need to rotate the rod 20 to return the squeezer 18 to a starting position near the top of the housing 14 in order to release the tube 12 when spent and permit the insertion of a new tube in the housing 14.

The dispenser 10 and its individual components can be formed from a variety of materials, though in a preferred embodiment each component of the dispenser 10 is made of a washable plastic allowing for thorough cleaning and sanitizing.

In use, the cover 16 is opened by pulling the upper end of the cover 16 outward away from the housing 14 to disengage the complementary detents 42 near the top of the housing 14 and cover 16 while the cover 16 pivots on the detents 42 located near the mutual lower ends of the housing 14 and cover 16. The squeezer 18 is removed from the housing cavity 44 and placed on the collapsible end of the tube 12, such that the end of the tube 12 is received in the slot 60 formed by the partial cylindrical sections 62. After removing the nozzle cap originally supplied with the tube 12, the tube 12 and squeezer 18 are placed together into the cavity 44 so that the tube 12 is between the squeezer 18 and the bottom wall 26 of the housing 14, the shoulder of the tube 12 rests in the recessed pocket 30 formed in the bottom wall 26, and the tube nozzle 34 protrudes through the opening 32 in the bottom wall 26. The cover 16 can then be raised and secured to the housing 14 with the detents 42, during which time the threads on the rod 20 engage the partial threads 58 on the squeezer 18. Toothpaste can then be dispensed from the tube 12 by rotating the rod 20 with the knob 50 to cause the squeezer 18 to travel downward toward the tube nozzle 34. After dispensing toothpaste from the tube 12, the tube nozzle 34 can be reclosed with a cap 72 that may be the original tube cap or one of any number of caps that can be provided with the dispenser 10 to fit various tube sizes on the market. In either event, the cap 72 can be tightened on the nozzle 34 to secure the tube 12 against the bottom wall 26 of the housing 14.

While the invention has been described in terms of a preferred embodiment, it is apparent that other forms could be adopted by one skilled in the art. For example, the housing 14, cover 16, and squeezer 18 could differ in appearance and construction from the embodiment shown in the Figures, and appropriate materials could be substituted for those noted. Therefore, the scope of the invention is to be limited only by the following claims.

What is claimed is:

1. An apparatus for dispensing the contents of a collapsible tube, the apparatus comprising:

a housing having an internal cavity defined in part by side walls and an end wall having an opening therein;

a cover pivotally attached to the housing adjacent the end wall thereof, the cover having a closed position relative to the housing and providing access to the internal cavity when in an open position;

squeezing means slidably received in the internal cavity of the housing, the squeezing means comprising a threaded surface facing the cover and a pair of opposing surfaces that define a slot, therebetween, the slot being aligned with the opening in the end wall of the housing and increasing in width in a direction toward the end wall; and a rod rotatably mounted to the cover so as to be pivotable therewith relative to the housing, the rod having an external thread surrounding an exterior cylindrical surface thereof that becomes threadably engaged with the threaded surface of the squeezing means by the act of closing the cover and becomes disengaged from the threaded surface of the squeezing means by the act of opening the cover, wherein rotation of the rod causes the squeezing means to move along the rod and through the internal cavity selectively toward and away from the end wall of the housing.

2. An apparatus according to claim 1, further comprising a knob mounted outside the cover and connected to the rod to enable rotation of the rod from outside the housing.

3. An apparatus according to claim 1, further comprising a base wall between the side walls and interconnecting the side walls and the end wall of the housing.

4. An apparatus according to claim 3, further comprising means on the base wall for mounting the housing to a vertical surface.

5. An apparatus according to claim 3, wherein the side walls are substantially parallel to each other and the base wall is substantially perpendicular to the side walls.

6. An apparatus according to claim 1, further comprising a transparent region on at least one of the side walls so that the internal cavity of the housing can be viewed therethrough.

7. An apparatus according to claim 1, wherein the opposing surfaces of the squeezing means are defined by partial cylindrical sections so as to be arcuate in profile.

8. An apparatus according to claim 1, wherein the opening in the end wall is sized to accommodate an end of the collapsible tube so that the end of the collapsible tube protrudes through the end wall and outside the housing.

9. An apparatus according to claim 1, wherein the squeezing means comprises a unitary block with oppositely-disposed sliding surfaces slidably engaging the side walls of the housing.

10. An apparatus according to claim 1, wherein the tube is disposed within the internal cavity of the housing between the squeezing means and the end wall of the housing, the tube having a nozzle end received in the opening in the end wall of the housing and an oppositely-disposed collapsible end engaged with the slot of the squeezing means, whereby movement of the squeezing means toward the end wall causes the collapsible end of the tube to be collapsed between the opposing surfaces of the squeezing means.

11. An apparatus according to claim 10, wherein the tube contains toothpaste.

12. An apparatus for dispensing the contents of a collapsible toothpaste tube having a nozzle end and an oppositely-disposed collapsible end, the apparatus comprising:

a housing having an internal cavity defined in part by a pair of substantially parallel, oppositely-disposed side walls, a base wall substantially perpendicular to and interconnecting the side walls, and an end wall transverse to and joining the side walls and base wall, the end wall having an opening therein sized to receive the nozzle end of the tube such that the nozzle end protrudes from the housing, the opening defining an axis that is substantially parallel to the side walls and base wall of the housing;

a cover pivotally attached to the housing adjacent the end wall thereof, the cover enclosing the internal cavity of the housing when in a closed position and providing access to the internal cavity when in an open position;

a unitary block slidably received in the internal cavity of the housing, the block comprising side multiple surfaces slidably engaged with the side walls and base wall of the housing, a pair of opposing partial cylindrical sections that define a slot therebetween that extends through the block, a surface facing the cover, and a partial internal thread defined in the surface facing the cover, the slot being aligned with the opening in the end wall of the housing and increasing in width in a direction toward the end wall; and a rod rotatably mounted to the cover so as to be pivotable therewith relative to the housing, the rod having an external thread surrounding an exterior cylindrical surface thereof that becomes threadably engaged with the partial internal thread of the block as the cover is pivoted to the closed position and becomes disengaged from the partial internal thread of the block as the cover is pivoted to the open position, wherein rotation of the rod causes the block to move along the rod and through the internal cavity selectively toward and away from the end wall of the housing; and a knob mounted outside the cover and connected to the rod to enable rotation of the rod from outside the housing.

13. An apparatus according to claim 12, further comprising means on the base wall for mounting the housing to a vertical surface.

14. An apparatus according to claim 12, further comprising a transparent region on at least one of the side walls so that the internal cavity of the housing can be viewed therethrough.

15. An apparatus according to claim 12, wherein the tube is disposed within the internal cavity of the housing between the block and the end wall of the housing, the nozzle end of the tube is received in the opening in the end wall of the housing and the collapsible end of the tube is engaged with the slot of the block, whereby movement of the block toward the end wall causes the collapsible end of the tube to be collapsed between the opposing partial cylindrical sections of the block.

16. An apparatus according to claim 15, further comprising a cap attached to the nozzle end of the tube.

17. An apparatus according to claim 12, further comprising a complementary detent means in the end wall of the housing and the cover adjacent the end wall for pivotally attaching the cover to the housing.

18. An apparatus according to claim 12, further comprising a complementary detent means in the housing and the cover for releasably securing the cover to the housing when the cover is in the closed position.

19. An apparatus according to claim 12, wherein the cover comprises a panel, a first flange extending from the panel at a first end of the cover adjacent the end wall of the housing, and a second flange extending from the panel at a second end of the cover opposite the first end thereof, the first and second flanges being transverse to the panel, the rod being rotatably supported by the first flange and extending through the second flange.

20. An apparatus according to claim 19, further comprising first complementary detent features in the first flange of the cover and the end wall of the housing for pivotally attaching the cover to the housing, and second complementary detent means in the housing and the second flange of the cover for releasably securing the cover to the housing when the cover is in the closed position.

* * * * *